US011297925B2

(12) United States Patent
Hwang et al.

(10) Patent No.: US 11,297,925 B2
(45) Date of Patent: Apr. 12, 2022

(54) REFILLABLE LIPSTICK CASE

(71) Applicant: Crystal International (Group) Inc.

(72) Inventors: Roger Hwang, Maple (CA); Stephen M Fisher, II, Sherman, CT (US); William Lloyd Alusitz, Yorktown Heights, NY (US)

(73) Assignee: CRYSTAL INTERNATIONAL (GROUP), Scarborough (CA)

( * ) Notice: Subject to any disclaimer, the term of this patent is extended or adjusted under 35 U.S.C. 154(b) by 42 days.

(21) Appl. No.: 16/989,683

(22) Filed: Aug. 10, 2020

(65) Prior Publication Data

US 2022/0039536 A1 Feb. 10, 2022

(51) Int. Cl.
*A45D 40/06* (2006.01)
*A45D 40/00* (2006.01)

(52) U.S. Cl.
CPC ..... *A45D 40/06* (2013.01); *A45D 2040/0056* (2013.01); *A45D 2040/0062* (2013.01)

(58) Field of Classification Search
CPC ..... A45D 40/06; A45D 2040/005; A45D 2040/0037; A45D 2040/0056; A45D 2040/0062
USPC ..... 401/68, 69–71, 73, 75, 77, 78
See application file for complete search history.

(56) References Cited

U.S. PATENT DOCUMENTS 2,546,195 A * 3/1951 Mellette ..... A45D 40/04 401/69
3,333,689 A * 8/1967 Terrill ..... A45D 40/04 401/76
4,505,607 A 3/1985 Sugiyama
5,399,040 A 3/1995 Holloway
6,186,686 B1 * 2/2001 Neuner ..... A45D 34/04 401/132
6,543,952 B1 4/2003 Ohba
2002/0015611 A1 * 2/2002 Blondeel ..... A45D 40/04 401/88
2009/0297249 A1 * 12/2009 Sawata ..... A45D 40/26 401/175
2011/0064511 A1 * 3/2011 Pires ..... B05C 17/0133 401/174
2012/0288321 A1 * 11/2012 Ishida ..... A45D 40/205 401/75
2013/0058700 A1 * 3/2013 Liu ..... A45D 40/18 401/52
2016/0183662 A1 * 6/2016 Heraud ..... A45D 40/02 401/68
2018/0020809 A1 * 1/2018 Soga ..... A45D 40/205 401/88

(Continued)

FOREIGN PATENT DOCUMENTS

EP 1285601 A2 2/2003

OTHER PUBLICATIONS

International Applicaiton No. PCT/US2021/045383, International Search Report and Written Opinion dated Jan. 5, 2022.

*Primary Examiner* — J C Jacyna
(74) *Attorney, Agent, or Firm* — Patterson + Sheridan, LLP

(57) ABSTRACT

A refillable lipstick case comprising a refill, an outer shell and a cover. The refill is configured to be detachably received at least partially within a hollow cylindrical body of the outer shell such that the refill can be replaced when a cosmetic stick held within the refill is used up by a consumer. The outer shell and the cover are retained for re-use, and the refill can be replaced with a new refill.

20 Claims, 6 Drawing Sheets

(56) References Cited

U.S. PATENT DOCUMENTS

| | | | | |
|---|---|---|---|---|
| 2019/0029398 | A1* | 1/2019 | Zhang | A45D 40/00 |
| 2019/0200727 | A1* | 7/2019 | Lee | A45D 40/04 |
| 2021/0007463 | A1* | 1/2021 | Lee | A45D 40/16 |

* cited by examiner

REFILLABLE LIPSTICK CASE

BACKGROUND

Field of the Invention

The present disclosure relates generally to a refillable lipstick case.

Description of the Related Art

Lipstick for adding color, texture, and protection to the lips has been available in cylindrical metal tubes since 1915.

A user conventionally must buy the lipstick dispensing tube with the lipstick, adding significant cost. The lipstick container has become so associated with the lipstick product it contains that the dispensing tube itself is also referred to as a "lipstick." The marketing of lipstick often becomes marketing of the dispenser tube. Since, the cost of the lipstick and dispenser combination is relatively high, a manufacturer may limit the number of lipstick types or lipstick colors to be offered, to avoid an overstock of relatively expensive dispensers containing less popular lipstick colors or shade variations.

Refill containers for consumer products are considered environmentally friendly in a way that lesser material is utilized in their manufacturing. These are also economical for the consumers as well as manufacturers. The consumers don't have to spend the same amount of money for the refills while for manufacturers they enable lower consumption of inputs such as raw materials and energy. Various attempts have been made to refine make-up packages such as compacts, lipsticks, etc. to provide an option of refilling the product.

The known refill containers for cosmetic products generally comprise of a refillable case that houses the product which may or may not have a propelling/dispensing mechanism therefore and such refills are then replaced into the refillable case once the product is used by the user. For example, there are available stick product packages which are refillable where a refill cartridge is replaced once the stick is used up by the user.

There is still a need for an improved refillable lipstick case in which removal and attachment of the refill is simple and easy.

SUMMARY

A refillable lipstick case according to present disclosure comprises a refill, an outer shell and a cover.

The outer shell has a hollow cylindrical body which has a sidewall with openings at both its proximal end, and distal end respectively. The refill is configured to be detachably received at least partially within the hollow cylindrical body of the outer shell such that the refill can be replaced when a cosmetic stick held within the refill is used up by a consumer. In other words, the outer shell and the cover are retained for re-use, and the refill can be replaced with a new refill.

The outer shell further comprises a neck portion at the distal end thereof, the neck portion includes features to detachably connect the cover at the neck portion. In the exemplary embodiment, the neck portion of the outer shell comprises an outer annular bead and the cover includes a corresponding annular groove at its inner surface for snap fitment. In alternative embodiments, the cover and the outer shell may be removably secured to each other by any other method known in the art for e.g. by threaded engagement, by elastic fitting, by clamping, by magnetization, by means of a bayonet attachment and the like.

The refill further comprises an inner shell, an inner body, a spiral body, a cup and a plug. The spiral body has an elongated hollow body and an inner surface of the elongated hollow body is provided with helical threads. The spiral body has an upper portion connected to the inner body and a lower portion connected to the plug. The spiral body and the inner body are connected by way of a rotatable snap and wherein for the rotatable snap the upper portion of the spiral body has on its outer surface, two circular ribs defining a groove between them and said groove is snap fitted on to a corresponding rib on an inner surface of the inner body.

The cup includes a cylindrical cup forming a seat for receiving a stick of product and a drive rod that extends downwardly from a bottom surface of the cylindrical cup. The drive rod is a flat rectangular rod. Protrusions are provided near a bottom end of the drive rod on two opposing narrow sides of the drive rod. The other two opposing sides of the rectangular drive rod are provided with a stop block. A bottom end portion of the drive rod is configured to be received in the hollow body of the spiral body such that the protrusions engage with helical threads of the spiral body and form a drive means for moving the cup relative to the outer shell between a stowed position of the cup in the inner shell and a usage position in which the stick emerges at least partially from an upper opening of the inner shell.

Further, the inner body has an inverted cup shape like body having a top end face and a cylindrical sidewall extending downwardly therefrom. The top end face of the inner body is provided with a hole through which the drive rod can pass through. More particularly, the hole has a cross-section similar to that of the drive rod therefore the drive rod of the cup passes through the hole of the inner body to engage with the helical threads formed on the inner surface of the spiral body. Because of the rectangular shape of the drive rod and rectangular shape of the hole, the cup can only move up and down, and cannot rotate. An upper portion of the spiral body extends into inside of the inner body and received therein such that there is an axial restraint connection between the inner body and the spiral body. According to a preferred embodiment, the upper portion of the spiral body is retained inside the inner body through a rotatable snap fitment, however in other embodiments it may be connected using any other methods known in the art that allows the spiral body and the inner body to be rotatably fixed to each other.

Further, the stop block of the drive rod limits upward movement of the drive rod by abutting against the inner surface of the top end face of the inner body when the drive rod reaches a maximum extended position.

Further, a lower portion of the inner shell is fixedly connected on an outer surface of the inner body, more particularly with the outer surface of the sidewall of the inner body, and an upper portion of the inner shell surrounds the cylinder cup of the cup completely.

The inner body has a protrusion on the outer surface of its sidewall which engages with a corresponding notch provided at a lower end of the inner shell so that the inner body and the inner shell are rendered non rotatable with respect to each other. In alternative embodiments, the inner body and the inner shell may be secured to each other by any other method known in the art for e.g. by threaded engagement, by elastic fitting, by clamping, by magnetization, by means of a bayonet attachment and the like.

A middle part of the spiral body is a bulged portion, and a lower surface of the bulged portion is provided with a plurality of reinforcing ribs in a radial arrangement, the plurality of reinforcing ribs engage with a stepped circular latch provided at an inner surface of the outer shell.

The plug is provided on a lower part of the spiral body such that the plug encases the lower part of the spiral body. The plug includes a sidewall and a bottom wall and a cavity for receiving the lower part of the spiral body. The sidewall of the plug includes a plurality of grooves that are radially spaced and that extend length wise from an upper edge of the sidewall. Each of the plurality of grooves extends through a complete thickness of the sidewall and up to a portion of a length of the sidewall of the plug. The plurality of grooves receives the corresponding reinforcing ribs of the spiral body when the plug and the spiral body are fixed together.

Further, each of the plurality of reinforcing ribs of the spiral body has a width greater than the thickness of the side wall, therefore a portion of each of the plurality of reinforcing ribs extends outward from the corresponding grooves when the reinforcing ribs are received into the corresponding grooves.

Furthermore, with respect to a central longitudinal axis of the refillable lipstick case, each of the plurality of reinforcing ribs extends at a greater radial distance than a radial distance at which the corresponding groove lie, therefore a portion of each of the plurality of reinforcing ribs extends outward from the corresponding grooves when the reinforcing ribs are received into the corresponding grooves. In other words, an outer diameter made by the plurality of reinforcing ribs is greater than a diameter made by the grooves of the plug. When the reinforcing ribs are fixed into the corresponding grooves, outer surfaces of the reinforcing ribs do not flush with corresponding outer surfaces of the grooves, and together form a non-contiguous outer surface.

After all the components of the refill are assembled together, the refill is inserted into the hollow outer shell preferably through the opening at the distal end of the outer shell. On inserting the refill, the reinforcing ribs of the spiral body engage with a stepped circular latch provided at the inner surface of the outer shell. Preferably, the portions of the plurality of reinforcing ribs extending outward from the corresponding grooves engage with a stepped circular latch provided at the inner surface of the outer shell. Further, the inner surface of the outer shell comprises longitudinal ribs at a lower end portion thereof which gives a tight fit with the sidewall of the plug of the refill such that the spiral body and the plug of the refill can't be displaced longitudinally and rotationally with respect to the outer shell.

In an assembled state, the bottom wall of the plug flushes with the bottom edge of the sidewall of the outer shell. To replace the refill, the outer shell is held in one hand and the refill is pushed through the opening at the proximal end of the outer shell towards the distal end of the outer shell, thereby overcoming forces of the tight fitment between the outer shell and the plug, and fitment between reinforcing ribs of the spiral body and the stepped circular latch.

In the assembled state, the inner body, and the inner shell are non-rotatable with respect to each other. Further, the outer shell, the plug and the spiral body are non-rotatable with respect to each other. Furthermore, the outer shell, the plug and the spiral body are rotatable with respect to the inner body, and the inner shell.

In use, a user holds the inner shell, and rotates the outer shell, causing rotation of the spiral body, while the inner body remains static. As a result, the protrusions of the drive rod move in helical threads of the spiral body, driving the drive rod and the cylindrical cup to move up and down in the inner shell.

More particularly, during use, the user rotates the outer shell in a first direction, which causes the rotation of the spiral body which in turn causes the axial movement of the drive rod with the cylindrical cup in upward direction to expose the product in the cup from the opening at the distal end of the outer shell.

After use, the user rotates the outer shell in a second direction opposite to the first direction, which causes the rotation of the spiral body in the second direction which in turn causes the axial movement of the drive rod with the cylindrical cup in downward direction to hide the product in the cylindrical cup inside the inner shell.

The outer shell may in particular be made of one of: glass, metal, ceramic, porcelain, crystal and plastic, especially polymethyl methacrylate, polystyrene, polycarbonate, polyethylene terephthalate, ionomer resin such as the ethylene vinyl copolymer known as trade name of Surlyn®, natural stone, synthetic stone, ceramics, porcelain, wood and urea formaldehyde.

The outer shell may be translucent, or even transparent. This gives the outer shell and the refillable lipstick case an aesthetic effect appreciated by the users. The outer shell may also be opaque.

The cover may be translucent, even transparent, or opaque otherwise. The cover is for example made of one of wood, a ceramic material, metal, porcelain, a rigid foam for example polyurethane type, natural stone, synthetic stone, mixed stone powder to a binder, converted by injection, leather, glass, crystal, plastic including sand thermoset plastic, such as formalin urea, or thermoplastic plastic, and/or especially frosted and/or varnished plastic and/or painted and/or metallized and/or galvanized and/or provided with visual effects, natural fabric, or synthetic fabric, or any other known material for making a cover.

The inner shell of the refill may especially be made of metal, aluminum, aluminum alloy, steel, glass, plastic, ceramic, porcelain, cardboard, especially coated cardboard or multilayer cardboard complexed with other materials such as metal sheets or plastic sheets. More noble materials such as porcelain, ceramic or glass, can be chosen to ensure an aesthetic effect. The use of these materials can also contribute to the aesthetic effect of the refillable lipstick case, especially when the outer shell is translucent or transparent.

The above summary provides a basic understanding of the aspects of the disclosure. This summary is not an extensive overview of all contemplated aspects, and is not intended to identify all key or critical elements or to delineate the scope of any or all aspects.

The above and other objects, features and advantages of the present disclosure will become clear from the following description of the preferred embodiments when the same is read in conjunction with the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings.

Figure 1:
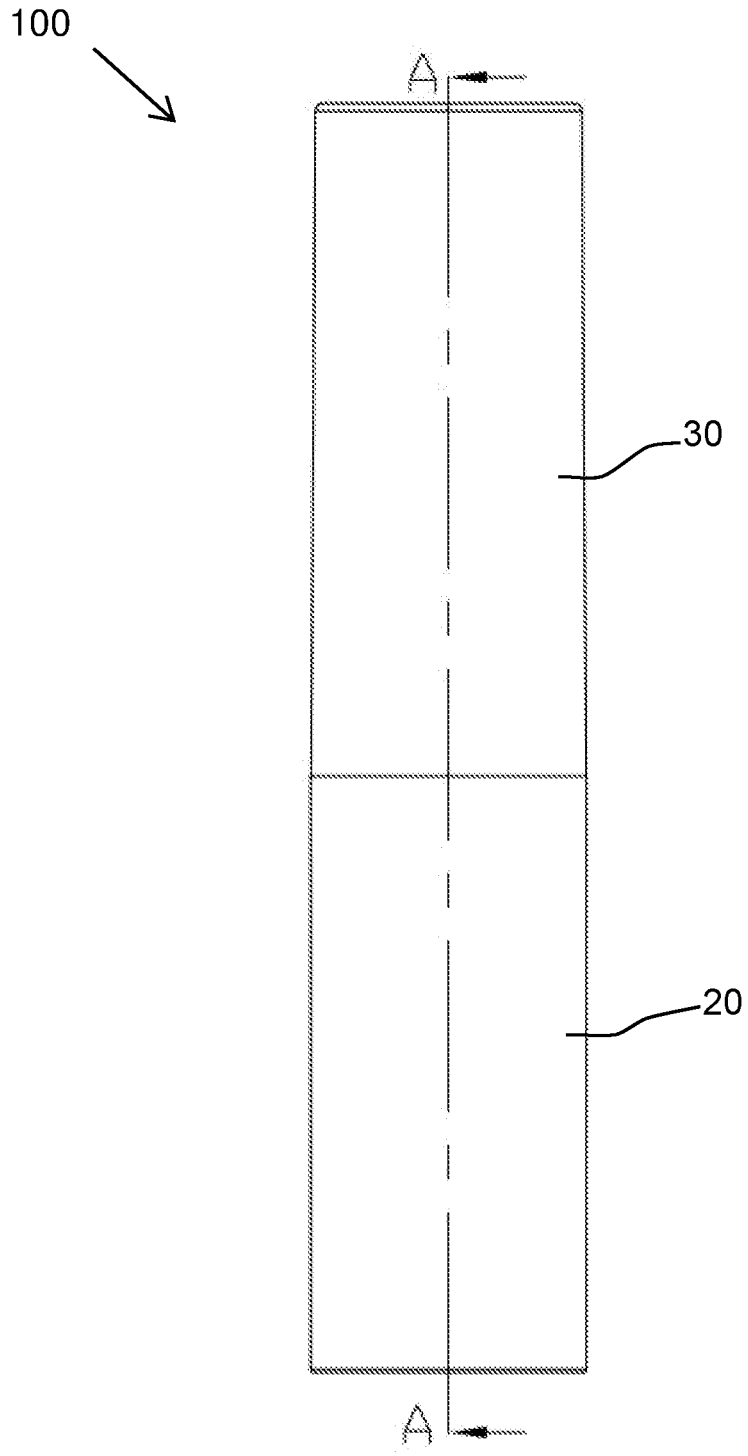
FIG. 1 shows a front view of a refillable lipstick case in a closed state according to an embodiment of the present disclosure.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

FIGS. 1-4, show a refillable lipstick case 100 extending along a central longitudinal axis A-A, according to present disclosure. The refillable lipstick case 100 comprises a refill 10, an outer shell 20 and a cover 30.

Figure 2:
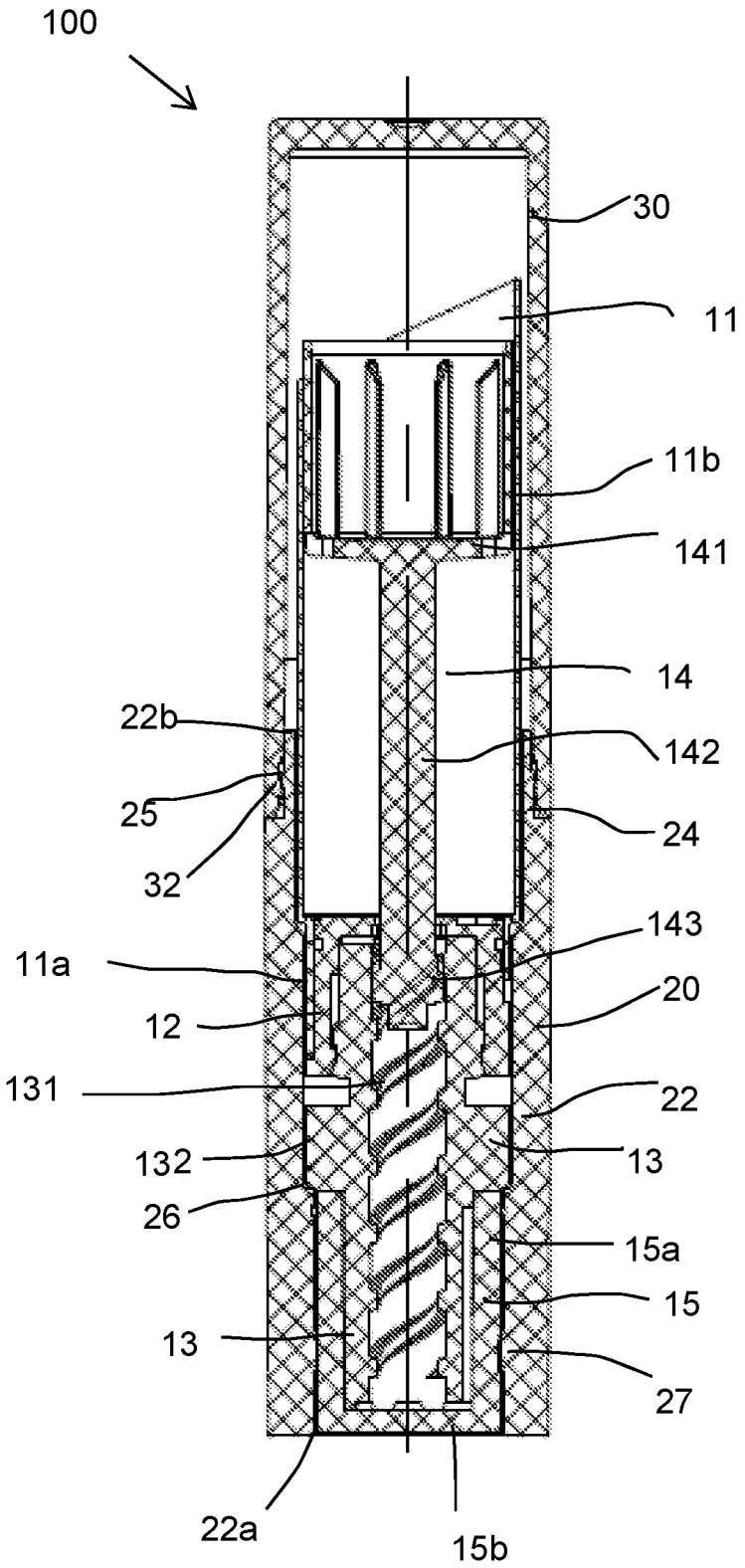
FIG. 2 shows a cross-sectional view of the refillable lipstick case of FIG. 1.
Figure 4:
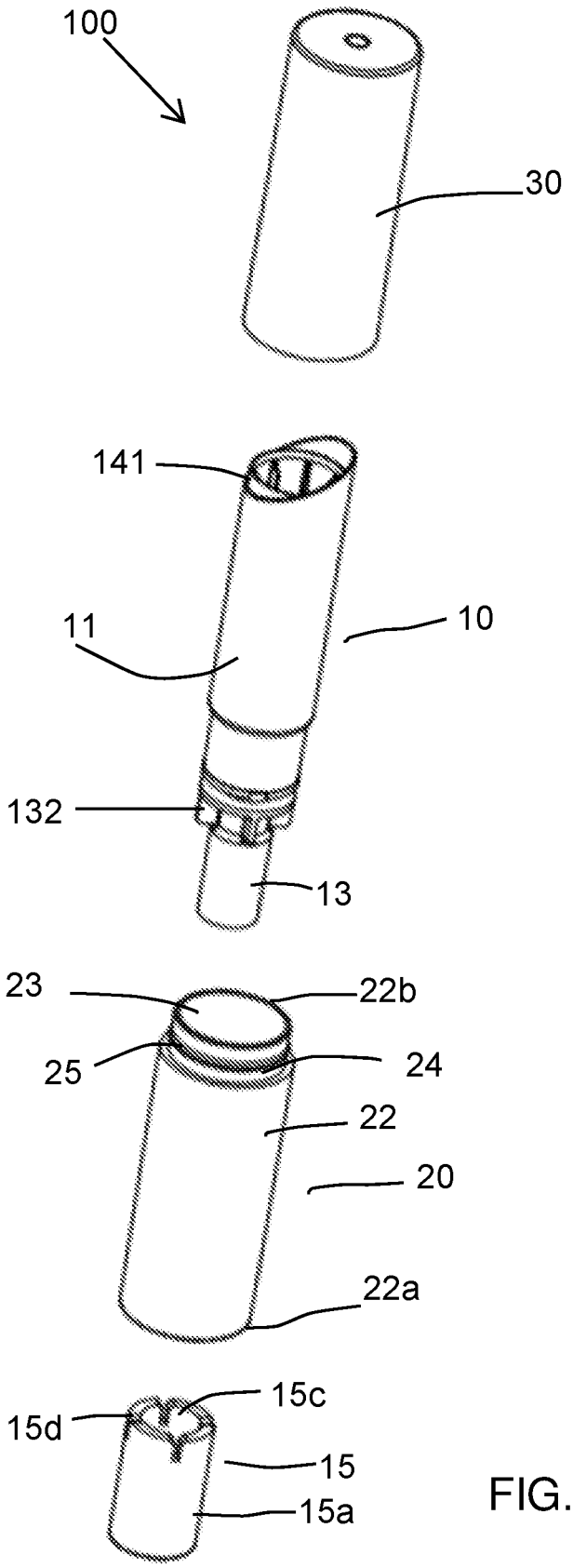
FIG. 4 shows an exploded view of the refillable lipstick case of FIG. 1.

As shown in FIGS. 2 and 4, the outer shell 20 has a hollow cylindrical body which has a sidewall 22 with openings 22*a* and 22*b* at both its proximal end, and distal end respectively, and defining a hollow cavity 23 therein. The refill 10 extends along the central longitudinal axis A-A and is configured to be detachably received at least partially within the hollow cylindrical body of the outer shell 20 such that the refill 10 can be replaced when a cosmetic stick (not shown) held within the refill 10 is used up by a consumer. In other words, the outer shell 20 and the cover 30 are retained for re-use, and the refill 10 can be replaced with a new refill 10.

As seen in FIGS. 2 and 4, the outer shell 20 further comprises a neck portion 24 at the distal end thereof, the neck portion 24 includes features to detachably connect the cover 30 at the neck portion 24. In the exemplary embodiment, as seen in FIG. 2, the neck portion 24 of the outer shell 20 comprises an outer annular bead 25 and the cover 30 includes a corresponding annular groove 32 at its inner surface for snap fitment. In alternative embodiments, the cover 30 and the outer shell 20 may be removably secured to each other by any other method known in the art for e.g. by threaded engagement, by elastic fitting, by clamping, by magnetization, by means of a bayonet attachment and the like.

Figure 7:
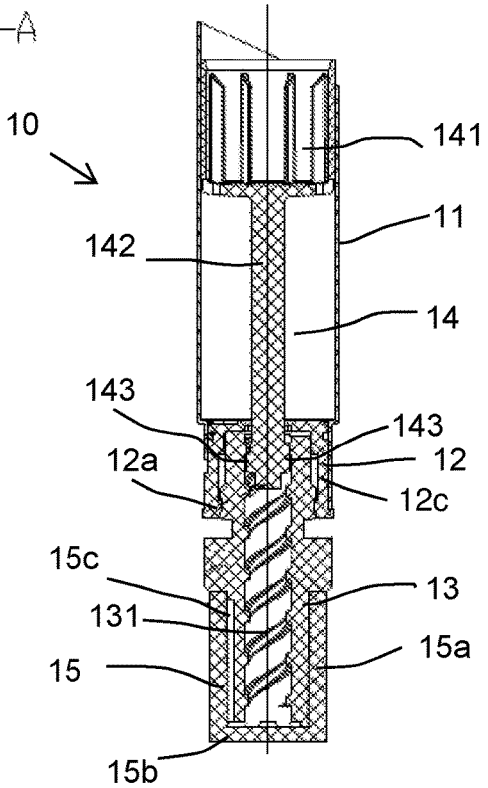
FIG. 7 shows a cross sectional view of the refill of FIG. 5.
Figure 8:
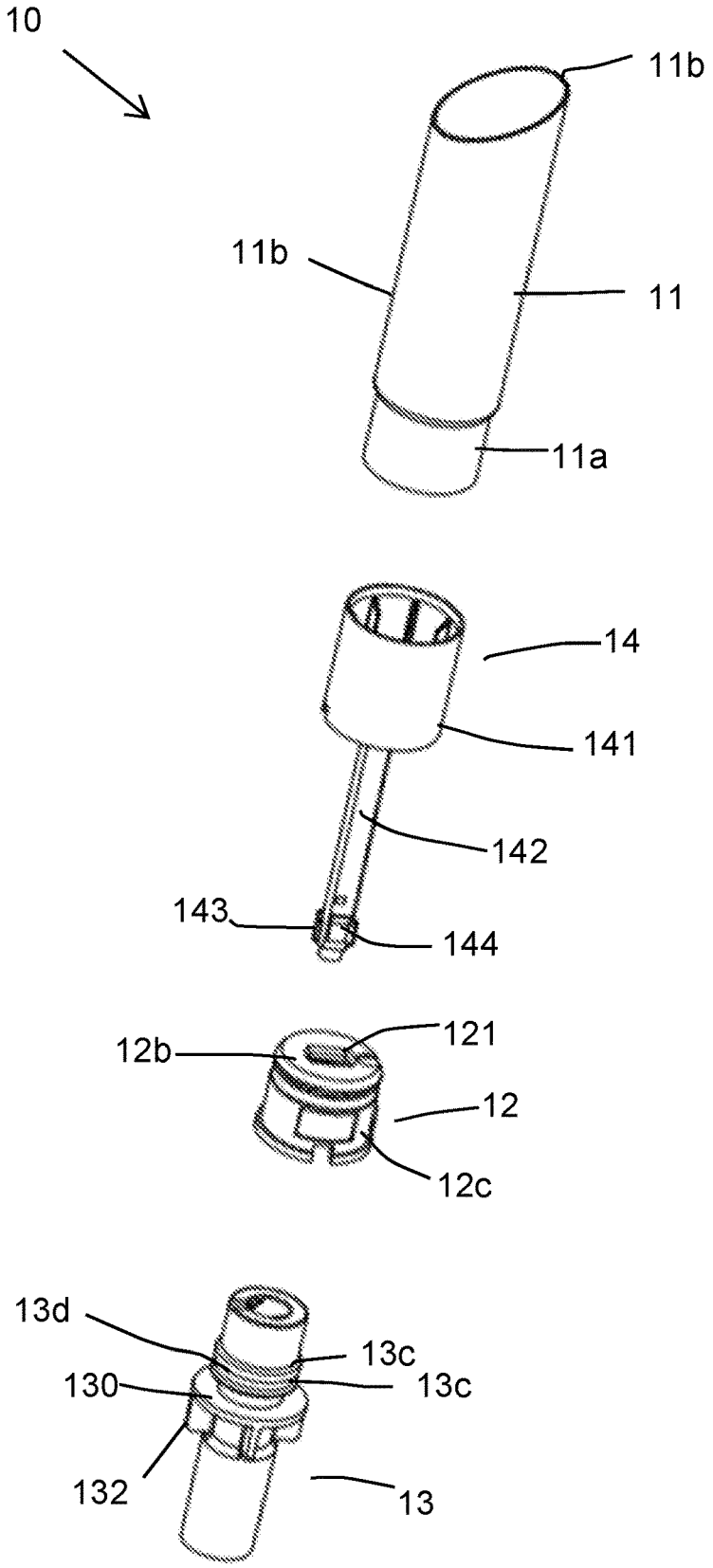
FIG. 8 shows an exploded view of the refill of FIG. 5 without showing a plug of the refill.

As seen in FIGS. 2, 7 and 8, the refill 10 further comprises an inner shell 11, an inner body 12, a spiral body 13, a cup 14 and a plug 15. The spiral body 13 has an elongated hollow body and an inner surface of the spiral body 13 is provided with helical threads 131. The spiral body 13 has an upper portion connected to the inner body 12 and a lower portion connected to the plug 15. Referring to FIG. 8, the spiral body 13 and the inner body 12 are connected by way of a rotatable snap and wherein for the rotatable snap, the upper portion of the spiral body 13 has on its outer surface, two circular ribs 13*c* defining a groove 13*d* between them and said groove 13*d* is snap fitted on to a corresponding rib 12*a* (see FIG. 7) on an inner surface of the inner body 12.

The cup 14 includes a cylindrical cup 141 forming a seat for receiving a stick of cosmetic product such as a lipstick and a drive rod 142 that extends downwardly from a bottom surface of the cylindrical cup 141. The drive rod 142 is a flat rectangular rod. Further, protrusions 143 are provided near a bottom end of the drive rod 142 on two opposing narrow sides of the drive rod 142. The other two opposing sides of the rectangular drive rod 142 are provided with a stop block 144. A bottom end portion of the drive rod 142 is configured to be received in the hollow body of the spiral body 13 such that the protrusions 143 engage with helical threads 131 of the spiral body 13 and form a drive means for moving the cup 14 relative to the outer shell 20 between a stowed position of the cup 14 in the inner shell 11 and a usage position in which the stick emerges at least partially from an upper opening of the inner shell 11.

Further, the inner body 12 has an inverted cup shape like body having a top end face 12*b* and a cylindrical sidewall 12*c* extending downwardly therefrom. The top end face 12*b* of inner body 12 is provided with a through hole 121 through which the drive rod 142 can pass through. More particularly, the hole 121 has a cross-section similar to that of the drive rod 142, therefore, the drive rod 142 of the cup 14 passes through the hole 121 of the inner body 12 to engage with the helical threads 131 formed on the inner surface of the spiral body 13. Because of the rectangular shape of the drive rod 142 and rectangular shape of the through hole 121, the cup 14 can only move up and down, and cannot rotate. An upper portion of the spiral body 13 extends into inside of the inner body 12 and received therein such that there is an axial restraint connection between the inner body 12 and the spiral body 13. According to a preferred embodiment, the upper portion of the spiral body 13 is retained inside the inner body 12 through a rotatable snap fitment as explained earlier, however in other embodiments it may be connected using any other methods known in the art that allows the spiral body 13 and the inner body 12 to be rotatably fixed to each other.

Further, the stop block 144 of the drive rod 142 limits upward movement of the drive rod 142 by abutting against the inner surface of the top end face 12*b* of the inner body 12 when the drive rod 142 reaches a maximum extended position.

Further, a lower portion 11*a* of the inner shell 11 is fixedly connected on an outer surface of the inner body 12, more particularly with the outer surface of the sidewall 12*c* of the inner body 12, and an upper portion 11*b* of the inner shell 11 surrounds the cylindrical cup 141 of the cup 14 completely, refer FIGS. 2 and 7.

The inner body 12 has a protrusion 123 (see FIG. 6) on the sidewall 12*c* which engages with a corresponding notch 11*c* provided at the lower portion 11*a* of the inner shell 11 such that inner body 12 and the inner shell 11 are non-rotatable with respect to each other. In alternative embodiments, the inner body 12 and the inner shell 11 may be secured to each other by any other method known in the art for e.g. by threaded engagement, by elastic fitting, by clamping, by magnetization, by means of a bayonet attachment and the like.

Referring to FIG. 8, a middle part of the spiral body 13 is a bulged portion 130, and a lower surface of the bulged portion 130 is provided with a plurality of reinforcing ribs 132 in a radial arrangement, the plurality of reinforcing ribs 132 engage with a stepped circular latch 26 provided at an inner surface of the outer shell 20 (refer FIG. 2).

Figure 5:
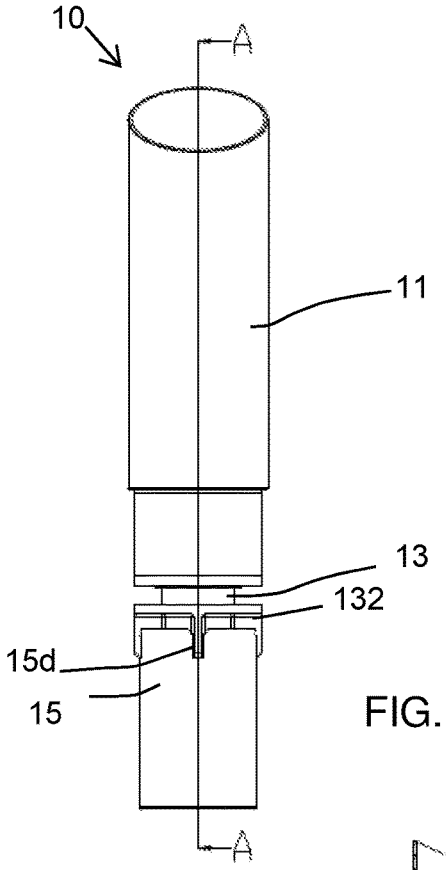
FIG. 5 shows a front view of a refill of the refillable lipstick case of FIG. 1.
Figure 6:
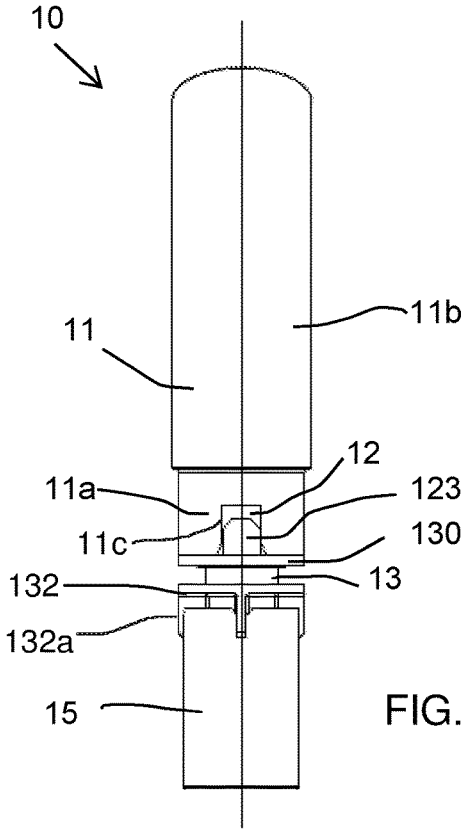
FIG. 6 shows a back view of the refill of FIG. 5.

As seen in FIGS. 5, 6 and 8, the plug 15 is provided on a lower part of the spiral body 13 such that the plug 15 encases the lower part of the spiral body 13. Referring to FIGS. 4 and 7, the plug 15 includes a sidewall 15*a* and a bottom wall 15*b* and a cavity 15*c* for receiving the lower part of the spiral body 13. The sidewall 15*a* of the plug 15 includes a plurality of grooves 15*d* which are radially spaced and extend length wise from an upper edge of the sidewall 15*a*. Each of the plurality of grooves 15*d* extend through a complete thickness of the sidewall 15*a* and up to a portion of a length of the sidewall 15*a* of the plug 15. The plurality of grooves 15*d* receives the corresponding reinforcing ribs 132 of the spiral body 13 when the plug 15 and the spiral body 13 are fixed together, see FIGS. 5-6.

Further, with respect to the central longitudinal axis A-A of the refill or the refillable lipstick case 100, each of the plurality of reinforcing ribs 132 extend at a greater radial distance than a radial distance at which the corresponding groove 15*d* lie, therefore a portion 132*a* of each of the plurality of reinforcing ribs 132 extends outward from the corresponding grooves 15*d* when the reinforcing ribs 132 are received into the corresponding grooves 15*d*. In other words, an outer diameter made by the plurality of reinforcing ribs 132 is greater than a diameter made by the grooves 15*d* of the plug 15. When the reinforcing ribs 132 are fixed into the corresponding grooves 15*d*, outer surfaces of the reinforcing ribs 132 do not flush with corresponding outer surfaces of the grooves 15*d*, and together form a non-contiguous outer surface.

After all the components of the refill 10 are assembled together, the refill 10 is inserted into the hollow outer shell 20 preferably through the opening at the distal end 22*b* of the outer shell 20. On inserting the refill 10, the reinforcing ribs 132 of the spiral body 13 engage with a stepped circular latch 26 provided at the inner surface of the outer shell 20, shown in FIG. 2. Preferably, the portions 132*a* of the plurality of reinforcing ribs 132 extending outwards from the corresponding grooves 15*d* engage with a stepped circular latch 26 provided at the inner surface of the outer shell 20. Further, the inner surface of the outer shell 20 comprises longitudinal ribs 27 at a lower end portion thereof which gives a tight fit with the sidewall 15*a* of the plug 15 of the refill 10 such that the spiral body 13 and the plug 15 of the refill 10 can't be displaced longitudinally and rotationally with respect to the outer shell 20.

In an assembled state, the bottom wall 15*b* of the plug 15 flushes with the bottom edge of the sidewall 22 of the outer shell 20, see FIG. 2. To replace the refill 10, the outer shell 20 is held in one hand and the refill 10 is pushed through the opening 22*a* at the proximal end of the outer shell 20 towards the distal end 22*b* of the outer shell 20, thereby overcoming forces of the tight fitment between the outer shell 20 and the plug 15, and fitment between the reinforcing ribs 132 of the spiral body 13 and the stepped circular latch 26.

In the assembled state, the inner body 12, and the inner shell 11 are non-rotatable with respect to each other. Further, the outer shell 20, the plug 15 and the spiral body 13 are non-rotatable with respect to each other. Furthermore, the outer shell 20, the plug 15 and the spiral body 13 are rotatable with respect to the inner body 12, and the inner shell 11.

In use, a user holds the inner shell 11, and rotates the outer shell 20, causing rotation of the spiral body 13, while the inner body 12 remains static. As a result, the protrusions 143 move in helical threads 131 of the spiral body 13, driving the drive rod 142 and the cylindrical cup 141 to move up and down in the inner shell 11.

Figure 3:
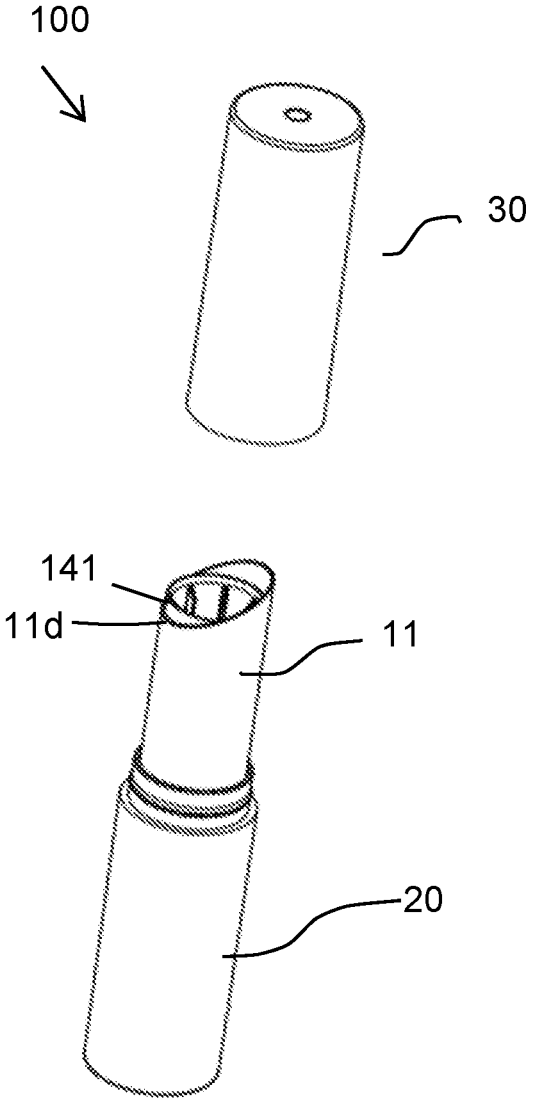
FIG. 3 shows a perspective view of the refillable lipstick case of FIG. 1 in an open state.

More particularly, during use, the user rotates the outer shell 20 in a first direction, which causes the rotation of the spiral body 13 which in turn causes the axial movement of the drive rod 142 with the cylindrical cup 141 in upward direction to expose the cosmetic product in the cylindrical cup 141 from the opening 11*d* at the distal end of the outer shell 11, see FIG. 3.

After use, the user rotates the outer shell 20 in a second direction opposite to the first direction, which causes the rotation of the spiral body 13 in the second direction which in turn causes the axial movement of the drive rod 142 with the cylindrical cup 141 in downward direction to hide the cosmetic product in the cylindrical cup 141 inside the inner shell 11.

According to an aspect of the present disclosure, the upper opening 11*c* at the distal end of the inner shell 11 is inclined with respect to the longitudinal axis of the lipstick case 100. In alternative embodiments, the upper opening at the distal end of the inner shell 11 may not be inclined.

The outer shell 20 may be translucent, or even transparent. This gives the outer shell and the refillable lipstick case an aesthetic effect appreciated by the users. The outer shell 20 may also be opaque.

The cover 30 may be translucent, even transparent, or opaque otherwise. The cover 30 is for example made of one of wood, a ceramic material, metal, porcelain, a rigid foam for example polyurethane type, natural stone, synthetic stone, mixed stone powder to a binder, converted by injection, leather, glass, crystal, plastic including sand thermoset plastic, such as formalin urea, or thermoplastic plastic, and/or especially frosted and/or varnished plastic and/or painted and/or metallized and/or galvanized and/or provided with visual effects, natural fabric, or synthetic fabric, or any other known material for making the cover.

The inner shell 11 of the refill 10 may especially be made of metal, aluminum, aluminum alloy, steel, glass, plastic, ceramic, porcelain, cardboard, especially coated cardboard or multilayer cardboard complexed with other materials such as metal sheets or plastic sheets. More noble materials such as porcelain, ceramic or glass, can be chosen to ensure an aesthetic effect. The use of these materials can also contribute to the aesthetic effect of the refillable lipstick case, especially when the outer shell is translucent or transparent.

The disclosure is not limited to the embodiments described above with reference to the FIGS. 1-8, but is, on the contrary, capable of many variants accessible to those skilled in the art. In particular, the characteristics of the various embodiments described can be combined in embodiments not illustrated in the FIGS. 1-8.

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variations that fall within the scope of the appended claims.

What is claimed is:

1. A refillable lipstick case comprising:

an outer shell having a hollow cylindrical body with a sidewall, the outer shell having an opening at a proximal end and an opening at a distal end thereof;

a cover removably secured to the outer shell;

a refill configured to be detachably received at least partially within the hollow cylindrical body of the outer shell;

wherein the refill further comprises an inner shell, an inner body, a spiral body, a cup and a plug;

wherein the spiral body has an upper portion connected to the inner body and a lower portion connected to the plug, and wherein the spiral body has an elongated hollow body provided with helical threads on an inner surface of the spiral body;

wherein the cup includes a cylindrical cup forming a seat for receiving a stick of a cosmetic product and a drive rod extending downwardly from a bottom surface of the cylindrical cup;

wherein a bottom end portion of the drive rod is configured to be received in the elongated hollow body of the spiral body such that protrusions present on the drive rod engage with helical threads of the spiral body;

wherein the drive rod passes through a hole provided on a top end face of inner body;

wherein a lower portion of the inner shell is fixedly connected on an outer surface of the inner body;

wherein a middle part of the spiral body is a bulged portion, and a lower surface of the bulged portion is provided with a plurality of reinforcing ribs in a radial arrangement, wherein the plug includes a sidewall and a bottom wall and a cavity for receiving the lower portion of the spiral body;

wherein the sidewall of the plug includes a plurality of grooves;

wherein the plurality of grooves are radially spaced and extend length wise from an upper edge of the sidewall of the plug, and wherein the plurality of grooves receives the reinforcing ribs of the spiral body when the plug and the spiral body are fixed together.

2. The refillable lipstick case according to claim 1, wherein each of the plurality of grooves extends through a complete thickness of the sidewall of the plug and up to a portion of a length of the sidewall of the plug.

3. The refillable lipstick case according to claim 1, wherein each of the plurality of reinforcing ribs of the spiral body extend at a radial distance with respect to a central longitudinal axis of the refill and wherein the radial distance of each of the plurality of reinforcing ribs is greater than a radial distance of each of the plurality of grooves with respect to the central longitudinal axis of the refill.

4. The refillable lipstick case according to claim 1, wherein a portion of each of the plurality of reinforcing ribs extends outward from the grooves when the plug and the spiral body are fixed together.

5. The refillable lipstick case according to claim 4, wherein the portion of each of the plurality of reinforcing ribs extending outward from the grooves engages with a stepped circular latch provided at an inner surface of the outer shell.

6. The refillable lipstick case according to claim 5, wherein the inner surface of the outer shell comprises longitudinal ribs at a lower end portion thereof providing a tight fit with the sidewall of the plug of the refill.

7. The refillable lipstick case according to claim 6, wherein the refill can be replaced by pushing the refill from the opening at the proximal end of the outer shell towards the distal end of the outer shell such that the refill overcomes frictional forces between the outer shell and the plug, and fitment between the reinforcing ribs of the spiral body and the stepped circular latch.

8. The refillable lipstick case according to claim 1, wherein when the plug and the spiral body are fixed together, outer surfaces of the reinforcing ribs do not flush with corresponding outer surfaces of the grooves, and together form a non-contiguous outer surface.

9. The refillable lipstick case according to claim 1, wherein the bottom wall of the plug is flush with a bottom edge of the sidewall of the outer shell.

10. The refillable lipstick case according to claim 1, wherein the refill is inserted into the hollow cylindrical body of the outer shell through the opening at the distal end of the outer shell.

11. The refillable lipstick case according to claim 1, wherein the outer shell further comprises a neck portion at the distal end thereof, and wherein the neck portion of the outer shell comprises an outer annular bead for snapping into a corresponding annular groove provided at an inner surface of the cover.

12. The refillable lipstick case according to claim 1, wherein the spiral body and the inner body are connected by way of a rotatable snap and wherein for the rotatable snap, the upper portion of the spiral body has on its outer surface, two circular ribs defining a groove between them and said groove is snap fitted on to a corresponding rib on an inner surface of the inner body.

13. The refillable lipstick case according to claim 1, wherein the drive rod is a flat rectangular rod and wherein the protrusions are provided near a bottom end of the drive rod on two opposing narrow sides of the drive rod.

14. The refillable lipstick case according to claim 1, wherein the outer shell, the spiral body and the plug are non-rotatable with respect to one another.

15. The refillable lipstick case according to claim 1, wherein the inner body and the inner shell are non-rotatably fixed with respect to each other.

16. The refillable lipstick case according to claim 15, wherein a sidewall of the inner body has a protrusion for engaging with a corresponding notch provided at the lower portion of the inner shell.

17. The refillable lipstick case according to claim 1, wherein when the outer shell is rotated in a first direction, the spiral body rotates in the first direction which in turn causes an axial movement of the drive rod with the cylindrical cup in an upward direction to expose the stick of the cosmetic product in the cylindrical cup from the opening at the distal end of the outer shell.

18. The refillable lipstick case according to claim 17, wherein when the outer shell is rotated in a second direction opposite to the first direction, the spiral body rotates in the second direction which in turn causes the axial movement of the drive rod with the cylindrical cup in a downward direction to hide the stick of the cosmetic product in the cylindrical cup inside the inner shell.

19. The refillable lipstick case according to claim 1, wherein the inner shell further comprises:

an upper opening at the distal end of the inner shell.

20. A refill for a refillable lipstick case, the refill extending along a central longitudinal axis and comprising:

an inner shell, an inner body, a spiral body, a cup and a plug;

wherein the spiral body has an upper portion rotatably connected to the inner body and a lower portion fixedly connected to the plug, and wherein the spiral body has an elongated hollow body provided with helical threads on an inner surface of the spiral body;

wherein the cup includes a cylindrical cup forming a seat for receiving a stick of a cosmetic product and a drive rod extending downwardly from a bottom surface of the cylindrical cup;

wherein a bottom end portion of the drive rod is configured to be received in the elongated hollow body of the spiral body such that protrusions present on the drive rod engage with helical threads of the spiral body;

wherein, the drive rod passes through a hole provided on a top end face of inner body;

wherein a middle part of the spiral body is a bulged portion, and a lower surface of the bulged portion is provided with a plurality of reinforcing ribs in a radial arrangement with respect to the central longitudinal axis, wherein the plug includes a sidewall and a bottom wall and a cavity for receiving the lower portion of the spiral body;

wherein the sidewall of the plug includes a plurality of grooves;

wherein the plurality of grooves is radially spaced and extend length wise from an upper edge of the sidewall, and wherein the plurality of grooves receives the reinforcing ribs of the spiral body; and wherein a portion of each of the plurality of reinforcing ribs extends outward from the grooves when the plug and the spiral body are fixed together.

* * * * *